US006279441B1

(12) United States Patent
Streblow

(10) Patent No.: US 6,279,441 B1
(45) Date of Patent: Aug. 28, 2001

(54) SYSTEM AND APPARATUS FOR CUTTING LOGS INTO SHORTER LENGTHS

(75) Inventor: Bernhard H. R. Streblow, Sapphire (AU)

(73) Assignee: Nicholson Manufacturing Company, Seattle, WA (US)

( * ) Notice: Subject to any disclaimer, the term of this patent is extended or adjusted under 35 U.S.C. 154(b) by 0 days.

(21) Appl. No.: 09/505,345

(22) Filed: Feb. 16, 2000

(51) Int. Cl.[7] ..... B26D 5/00

(52) U.S. Cl. ..... 83/75.5; 83/102; 83/109; 83/368; 83/371; 83/425.4; 83/508.3; 83/104; 144/242.1; 144/379; 144/357; 209/518

(58) Field of Search ..... 83/13, 70, 75.5, 83/102, 104, 109, 111, 112, 107, 371, 425.4, 499, 508.3, 367, 368, 23, 27; 144/242.1, 250.24, 250.25, 356, 357, 379, 382; 209/517, 518, 621; 198/403, 347.3, 607, 608

(56) References Cited

U.S. PATENT DOCUMENTS

| | | | | |
|---|---|---|---|---|
| 1,802,514 | * | 4/1931 | Johnson | 83/425.4 |
| 4,040,459 | * | 8/1977 | Bush, Jr. et al. | 83/112 |
| 4,170,911 | * | 10/1979 | Ayers et al. | 83/104 |
| 4,294,149 | * | 10/1981 | Olsson | 83/75.5 |
| 4,468,993 | * | 9/1984 | McCown et al. | 83/75.5 |
| 6,032,564 | * | 3/2000 | Bowlin | 83/75.5 |

* cited by examiner

*Primary Examiner*—W Donald Bray
(74) *Attorney, Agent, or Firm*—Seed IP Law Group PLLC

(57) ABSTRACT

A log processing system contains a row of tipple units for supporting a log to be cut into programmed lengths by saws swing-mounted on carriages selectively positioned on a truck extending beside said row. Each tipple unit has two oppositely extending wings each independently moveable between upwardly sloped and downwardly sloped positions. The tipple units at the cutting positions have their wings lowered out of the cutting range of the saws. Log hold-down arms operate from the carriages in conjunction with the saws.

17 Claims, 8 Drawing Sheets

SYSTEM AND APPARATUS FOR CUTTING LOGS INTO SHORTER LENGTHS

TECHNICAL FIELD

The present invention relates to log processing systems for cutting full length logs into a number of lengths and cleared of waste sections to suit further processing to maximize yield.

BACKGROUND OF THE INVENTION

Log processing systems have been developed to cut full length logs (stems) such as to discard unwanted shapes and other waste longitudinal increments and at the same time divide the remainder of the log into a number of lengths suitable for further saw milling programmed to achieve a maximum yield. Most of these systems are based on the concept of longitudinally advancing a log on a conveyor having a gap for operation of a cutoff saw, and using a number of incrementally spaced log stops located downstream of the gap to set the lengths to be cut responsive to a programmed extension and retraction of the stops. This requires that the conveyor be stopped for each cut, and hence is inherently a relatively slow procedure. There are some systems which are more sophisticated, but none are known to applicant that will consistently achieve more than about 15 cuts/minute although there is a need for a faster cutting system.

SUMMARY OF THE INVENTION

The present invention aims to provide an improved log processing system capable of handling for example, six log stems/min. up to 25 meters long, and cutting them in five places to produce an average of six random lengths including rejects (waste). To this end a log handling tipple system was developed to function in conjunction with multiple linear moving saw carriages allowing a non-incremental cutting operation. The cutting is performed by circular saws which are swing-mounted on the carriages and operate simultaneously. The tipple system is fed with logs from an indexing loader such as a log ladder, and the logs are held down during cutting by log clamps mounted on the saw carriages. Dimension cut stems and waste pieces are discharged by the tipple system onto longitudinal conveyors on opposite sides.

The tipple system comprises a row of tipple units each having a pair of arms or wings (tipples) pivoted on a common axis to swing at opposite sides of a longitudinal support between upwardly sloped and downwardly sloped positions. The tipples are controlled to selectively occupy log support, log discharge, waste discharge, and saw cut positions in concert with operation of the loader, positioning of the saw carriages, and operation of the saws and log clamps on the carriages. When a tipple unit is in the saw cut position, a saw can cut completely through the log at the tipple position without engaging the unit.

DETAILED DESCRIPTION OF THE INVENTION

Figure 1:
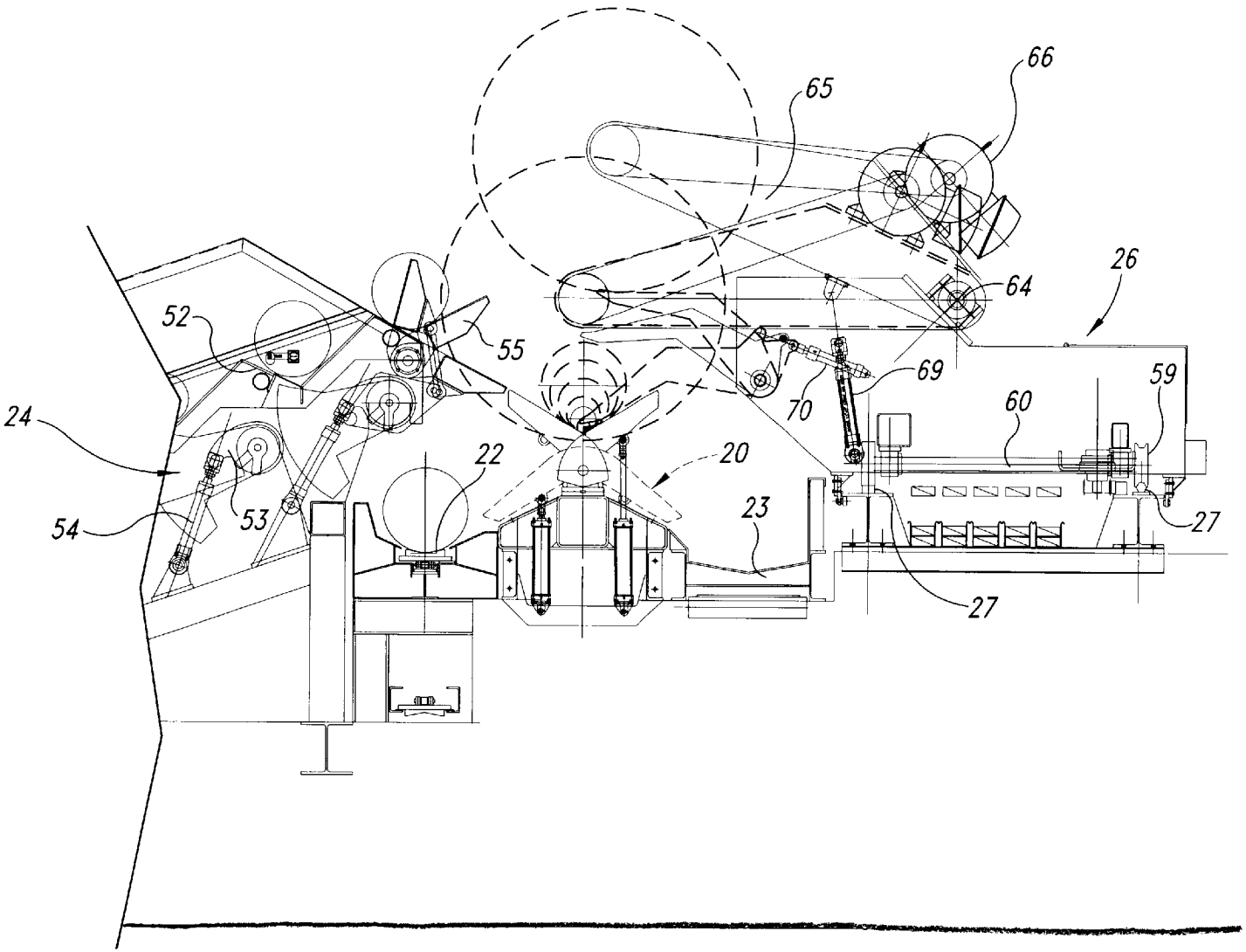
FIG. 1 is an end view of the system with the log ladder and the saw carriage being partially shown.

Referring to the drawings, a row of special tipple units 20 is mounted between a log section discharge conveyor 22 and a waste discharge conveyor 23, and acts in conjunction with an indexing log loader 24 and a group of self-contained saw carriages 26 riding on a pair of track rails 27–28. Each saw carriage 26 has swingably mounted thereon a pair of log clamping arms 30–31 and a circular saw blade 32 which are swingable independently from an inactive position spaced above the tipple units 20 and an active position holding down and cutting a log fed from the log loader 24 onto the tipple units. The saw carriages are moved along the rails into an optimizing cutting position best suited for each log by action of driving pinions 34 meshing with a rack 36 extending along the rail 27. As will now be explained in detail, the tipple units 20 opposite the saw blades 32 are set in a lowered position spaced below the cutting path of the blades each time the saw carriages 26 are positioned.

Figure 8:
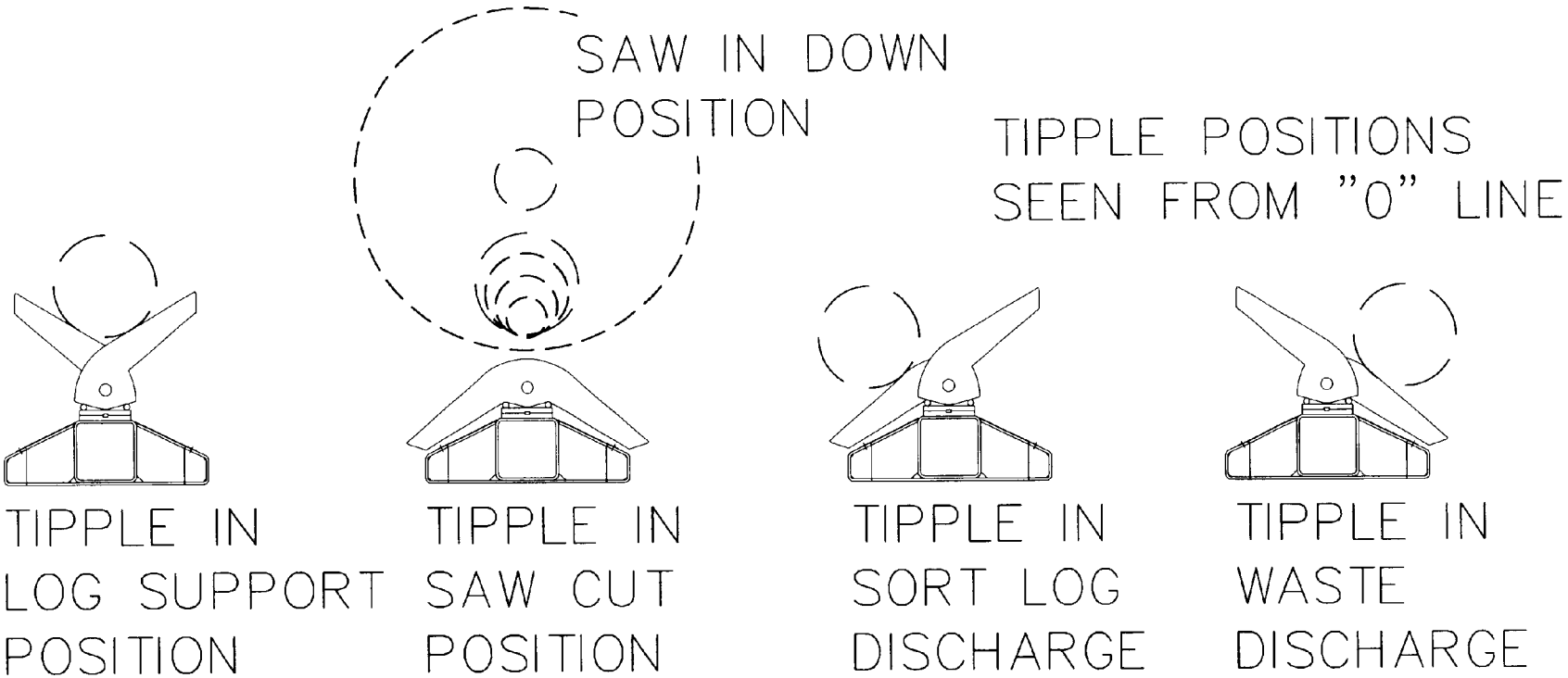
FIG. 8 is a schematic plan view illustrating the system.

The tipple units 20 are typically about two feet in length and are mounted relatively close together on a central tubular stringer 38 which may serve as a compressed air reservoir. The stringer 38 is seated on a transverse plate 39 mounted on a pair of side channels 40 which fit onto base saddles 42. Cheek plates 43–43' slope from the tubular stringer 38 downwardly to the outer edges of the transverse plate 39. Each tipple unit has a pair of pillow blocks 44 fixed to a base plate 45 by bolts anchored to the stringer 38. The pillow blocks support a fixed shaft 46 projecting endwise from the pillow blocks 44 to receive bearings for outer and inner pairs of hubs 48 and 49 on which two swing arms or wings (tipples) **20*a*–20*b* are fixed by way of end flanges 47*a*–47*b* on the wings. The surface of the wing 20*a* extends to its inner edge as an arched portion 20*a*' partly surrounding the shaft 46 in radially spaced relation thereto. The two tipples are selectively individually swung to an upwardly sloped position or a downwardly sloped position by a pair of doubleacting pneumatic cylinders 50–51 extending upwardly from the saddle 42 to pivotal connections 50*a*–51*a* with ears on the underside of the tipples. Solenoid values control compressed air flow to and from the cylinders 50–51 via hoses 50*b*–*c* and 51*b*–*c* the solenoids are individually wired from a central control station for operation responsive to the output of the computer programming. Each tipple unit 20 has four alternative positions shown in FIG. 8**, namely:

(1) a "log support position" where both tipples **20*a*–20*b*** diverge upwardly to form a vee-shaped holder;

(2) a "log discharge position" in which the left tipple is lowered to slope as a ramp for discharge of a cut log section, onto the log section conveyor 22, while the right tipple remains raised;

(3) a "waste discharge position" in which the right tipple arm is lowered to slope as a ramp for discharge of a waste section of a cut long onto the waste conveyor 23 while the left tipple remains raised; and (4) a "saw cut position" in which both tipples are lowered into an inverted vee configuration.

Figure 2:
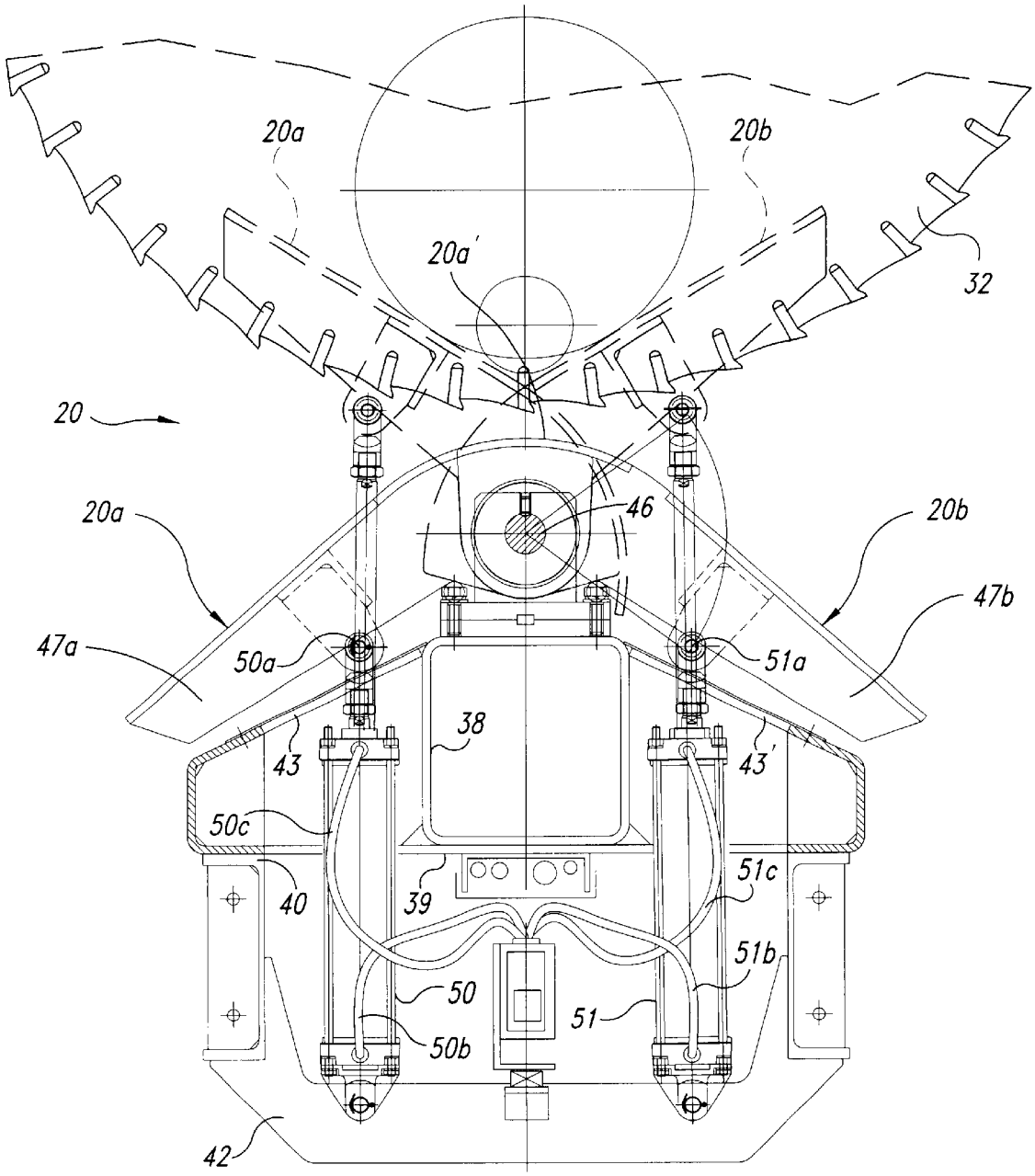
FIG. 2 is an end view of a tipple unit.
Figure 3:
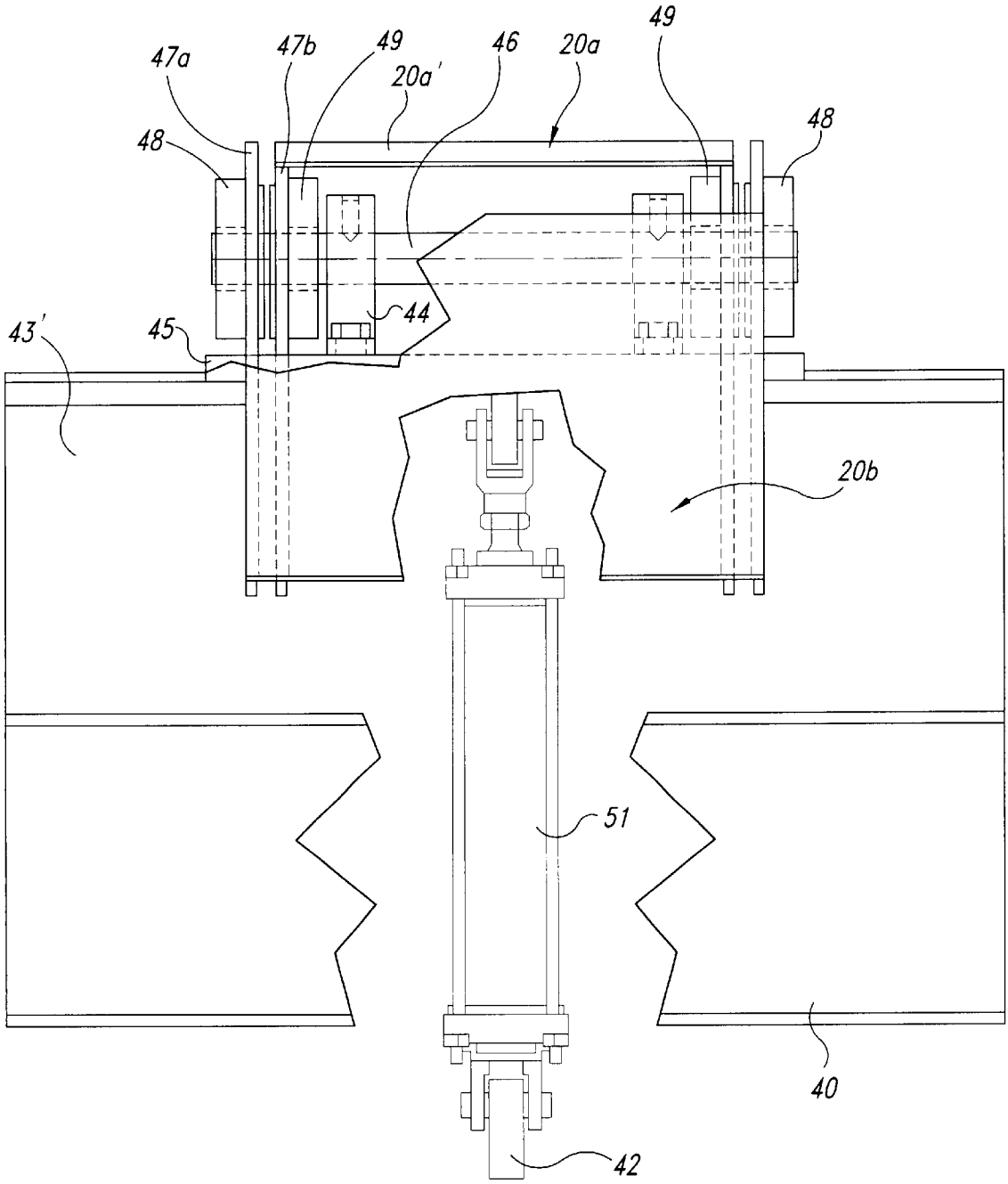
FIG. 3 is a side view of a tipple unit.

In the saw cut position both tipples in the tipple unit are spaced below the lowest cutting path of the saw blades as indicated by the broken line representation of the blade in FIG. 2, which is spaced above the arched inner end portion **20*a*' of the tipple 20*a***.

The log loader 24 may take the form of a multi-stage log ladder fed from a scanner conveyor leading from a debarker. The log is scanned in a conventional manner to determine and record size, taper, and waste sections so that a computer program can determine the optimum lengths for cutting the log. The program controls the locations of the saw carriages and those tipple units to be in the saw cut position when the scanned log reaches the tipple units. For purposes of example, a ladder may have four sloped steps 52. A pusher arm 53 at each step is swung by action of a respective hydraulic cylinder 54 on a crank coupled to the pusher arm. Each stroke of the cylinder 54 rolls the log occupying the respective step up a riser to the next higher step. When a log reaches the top step it is released and pushed by a transfer gate 55 to roll down onto those of the tipple units having their tipples raised into the log support position. Operation of the log ladder is coordinated with operation of the tipple system so that a minimum of time is required after a log is cut until the next log is loaded and ready to be cut.

Directing attention to the saw carriages 26, each has a frame 60 supported on wheels 59 riding on the rails 27–28. Cable chain (caterpillar) units operating beneath the base frame between the tracks can be used to handle power cable for motors on the carriages and control cabling from a central control station. The frame 60 has two front raised housing sections 61–62 spaced by a gap 63. The back walls of the front housing sections are sloped and support aligned horizontal journals 64 for a generally triangular saw swing frame 65 which reaches forwardly beyond the carriage frame 60. An electric motor 66 mounted on the sloped back of the swing frame 65 has a multi-belt or chain drive 67 to a front shaft 68 connected to the backing hub for the circular saw blade 32. A hydraulic cylinder is pivotally mounted at opposite ends on the frame 60 and the swing frame 64 to operate between the housing sections 61–62 for selectively raising and lowering the saw blade in a vertical plane midway of the width of the housing section 62. Projecting from the latter on opposite sides of the saw blade are the two log clamping arms 30–31 swing-mounted on a common swing axis. Each of these clamping arms is operated by a respective hydraulic cylinder 70 engaging a crank on the arm so that the downward clamping travel of the arms can vary from one another to allow for differences in log contour on opposite sides of the saw.

Each saw carriage has its own hydraulic system including a hydraulic pump driven by an electric motor. The pump feeds a hydraulic motor coupled to the respective drive pinion 34, and feeds the hydraulic cylinders 68,70 for raising and lowering the saw and the clamping arms. Flow to and from these hydraulic cylinders is controlled by solenoid valves. The solenoids for these valves and a controller for the hydraulic motor driving the pinion 34 are programmed and operated from the central control station.

Figure 7:
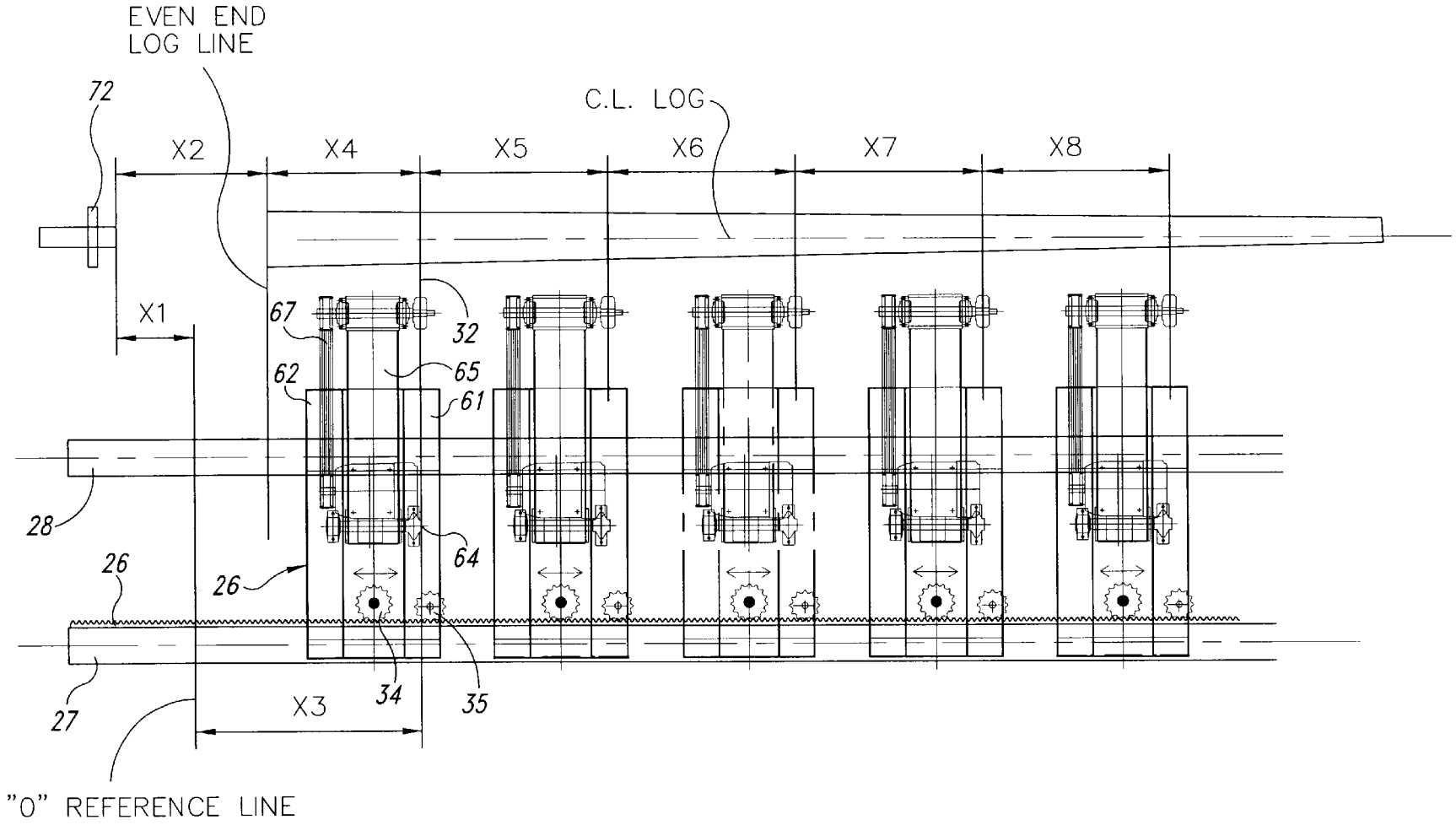
FIG. 7 is a schematic plan view showing the saw carriage positioning and drive arrangement.

Referring to FIG. 7, a log is shown in tipple supported position and five saw carriages 26 are shown supported on rails 27–28. Rack 36 extends along the side of rail 27 and is meshed with a drive pinion 34 and an encoder pinion 35 for each carriage.

An ultrasonic length measuring device 72 is mounted in alignment with the center line of the tipple units in a fixed position spaced a distance X1 from a "0" reference line to measure the distance X2 to the adjacent end of the log. This establishes X2 minus X1 as the distance of the log end from the "0" reference line. The saw carriage positioning system and programming references from the "0" reference line and is a standard digital, closed loop electrohydraulic servo positioning system using incremental encoders coupled to the encoder pinions 35 to provide position feedback. For start up or reset, all modules (carriages) are at respective home positions referenced to the "0" reference line. In FIG. 7, X3 is the saw line (cutting position) for saw #1 relative to the "0" reference line and is based on computer calculations resulting from (a) scanned log dimensions determined by scanning of the log prior to loading, (b) preprogrammed cutting patterns (preferences) and (c) log end position (X2–X1). In FIG. 7, X4 is the actual length of the first log section to be cut. Lines X5 through X8 represent the preference lengths of the remaining log sections to be cut by saws #2 through #5. Each of the saw carriages has a respective distance X3 calculated by the computer at the control station as the distance from the "0" reference line to the cutting line of the respective saw blade, and has an initial home position located so that the carriages are initially spread apart so that the distance that the carriages will need to be moved between cuts will be minimized. At the completion of the cutting operation on a log, the carriages can be simultaneously prepositioned to move to their respective home positions and then each move to new computer calculated cutting positions for the next log in accordance with the computer calculations for that log. In the alternative, the computer programming can be established to determine the travel distance and direction for each saw carriage from its last cutting position to its next one so that the carriages move directly between cutting positions rather than being prepositioned at their home positions during each moving cycle.

Figure 6:
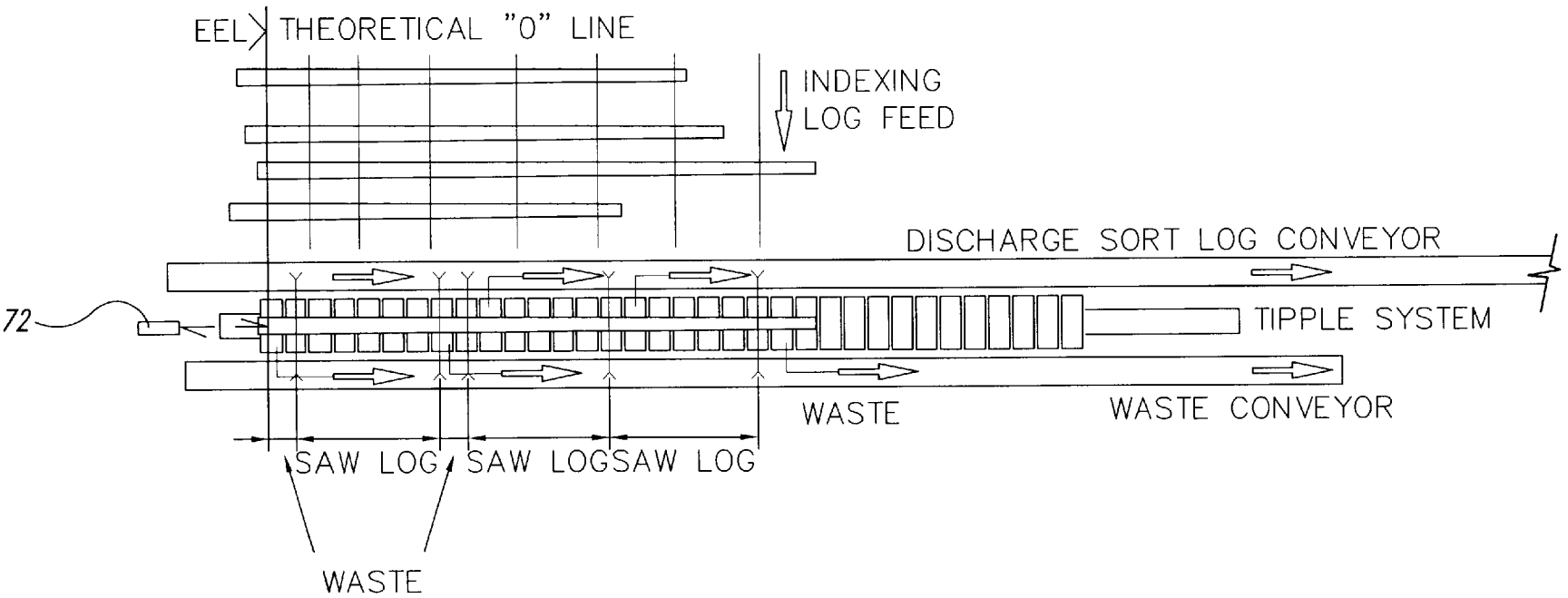
FIG. 6 is a schematic showing four tipple positions.

Directing attention to the schematic of FIG. 6, as an example four logs are shown on the log feeder and a log is shown on the tipple system after five saw cutting lines have been determined by a computer solution. The five tipple units 20 at the cutting positions are set at their lowered saw cut position as the saw carriages 26 move to their cutting positions in accordance with the computer solution. As previously indicated, ultrasonic sensor 72 spaced from the head of the row of tipple units is used to detect the actual position of the log end in relation to the theoretical "0" line for correct positioning of the saws. In the illustrated example the computer solution has provided three log sections of equal length, waste sections at the head and foot ends of the log, and an intermediate waste section. After the cutting operation, as the saws are retracted and the hold-down arms 30–31 are raised, the tipples holding the three good log sections are moved to their log discharge position and the tipples beneath the three waste sections are moved from their saw cut position to their waste discharge position. As soon as the log and waste sections are clear of the tipples the tipples are reset to their log support position.

Figure 4:
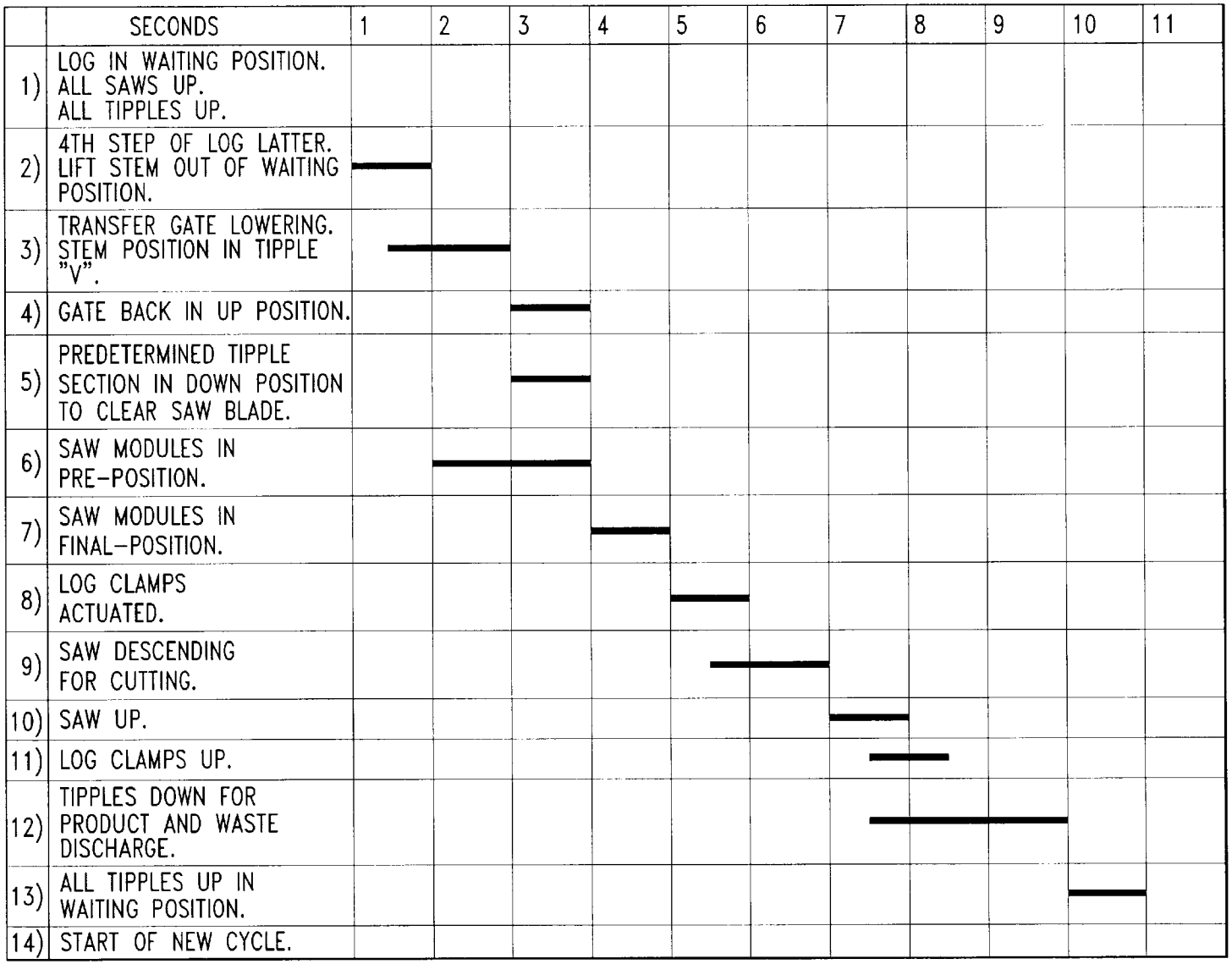
FIG. 4 is a chart showing the relative timing of the system operations.
Figure 5:
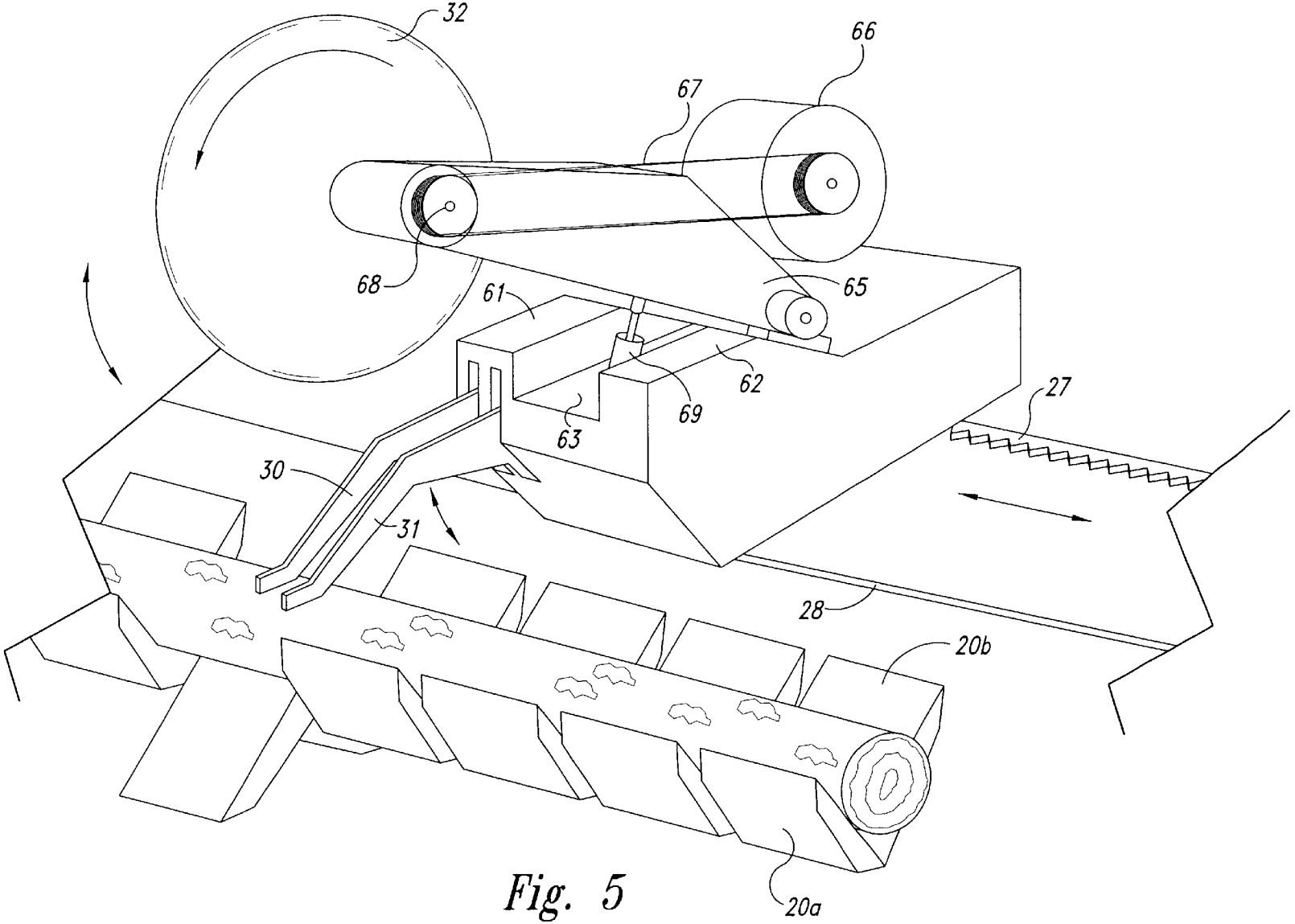
FIG. 5 is a fragmentary perspective view showing a log carriage with its log clamps in clamping position and its saw raised.

Directing attention to FIG. 4, there is shown a chart setting out the sequence in a 10 second operational cycle in accordance with the invention starting with a log ready to be discharged from the log ladder. It will be noted that to compress the cycle, in several instances certain of the steps are performed in whole or in part simultaneously. For example, during seconds 2 and 3 the saw modules are being pre-positioned while the transfer gate of the log ladder is lowering and raising and the appropriate tipple units are being set in the lowered saw cut position. An additional second is provided to complete positioning of the saw carriages. As a further compression example, during seconds 7 and 8 the saws are swinging up after their cutting operation during seconds 5 and 6, log clamps are raising, and the tipple units are adjusting to lower the appropriate tipples for product and waste discharge. After raising of the log clamps has been completed following raising of the saws, and the tipples have been appropriately lowered for product and waste discharge, 1½ seconds is provided for actual dumping of the log lengths and waste sections onto the appropriate conveyors. The described 10 second cycle is designed to provide 30 cuts/minute in the illustrated 5-saw system. It will be appreciated that the described operating cycle can be fine tuned for a given installation.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A tipple unit comprising:

a support;

two tipple wings swing-mounted on said support to independently swing in opposite directions between diverging upwardly sloping raised positions and diverging downwardly sloping lowered positions, said wings presenting a vee-shaped log support when they are both in said raised positions, and each wing providing a discharge ramp when it is in said lowered position; and means for selectively raising and lowering each of said wings between said positions.

2. A tipple unit according to claim 1 in which said tipple wings are mounted to swing on the same axis.

3. A tipple unit according to claim 1 in which a shaft is mounted on said support and each tipple wing is journal-mounted at two axially-spaced locations on said shaft, the said locations for one of said wings being closer to the ends of the said shaft than the said locations for the other of said wings.

4. A tipple unit according to claim 1 in which said tipple wings provide a saw clearance space above the wings when they are both in said lowered position, so that when a log is supported on a row of said tipple units having each of their wings in raised position, a cutoff saw blade can cut transversely through the log at the location of one of said tipple units when its wings are moved to said lowered position.

5. A log processing apparatus comprising:

a row of tipple units, each of said tipple units having two tipple wings swing mounted to independently swing in opposite lateral direction between diverging upwardly sloping raised positions and diverging downwardly sloping lowered positions, said wings presenting a vee-shaped log support when they are both in said raised positions, and each wing providing a discharge ramp when it is in said lowered position;

means for selectively raising and lowering each of said wings between said positions;

a saw movable along a path at one side of said row for cutting through a log supported on said tipple units at a variable location, the said lowered position of said tipple units being such as to provide a saw clearance for the tipple unit at said location.

6. A log processing apparatus according to claim 5 in which said extensible units comprise pneumatic cylinders.

7. A log processing apparatus according to claim 5 in which said saw is mounted on a carriage mounted on rails on said path, and in which a log loader is mounted on the other side of said row.

8. A log processing apparatus according to claim 5 in which a conveyor extends along one side of said row to carry log sections discharged from said tipple units.

9. A log processing apparatus according to claim 5 in which conveyors extend along opposite sides of said row, one to carry log sections and the other to carry waste discharged from said tipple units.

10. A log processing apparatus according to claim 9 in which one of said conveyors is located between a log loader and said row, and in which the other of said conveyors is mounted at the other side of said row between the row and said saw path.

11. A system for cutting logs into shorter longitudinal sections, comprising:

supporting the log on a row of tipple units;

determining the cutting locations for dividing the log longitudinally into log sections of selected lengths;

moving cut-off saws to said cutting locations and moving those of said tipple units located at said cutting locations out of the cutting range of said saws while continuing to support said log on other of said tipple units, operating said saws to cut transversely through the log at said cutting locations to obtain said log sections; and then adjusting the tipple units which are supporting the cut log such as to discharge said log sections from the tipple units.

12. A system for cutting logs into shorter longitudinal sections, comprising:

providing a row of tipple units each having oppositely swingable swing wings which are each swingable transversely of said row between an upwardly sloped raised position and a downwardly sloped lowered position;

positioning said tipple wings in their said raised position and loading a log onto said tipples so that it is supported by said raised wings;

moving cut-off saws to multiple cutting locations along the supported log and lowering all of said wings located at said cutting locations out of the cutting range of said saws while supporting said log between said cutting locations by other of said wings;

operating said saws to cut transversely through the log at said cutting locations to obtain said log sections; and lowering sufficient of said wings at a selected lateral side of said row to said lowered position to discharge said log sections laterally to said selected sides.

13. A system for cutting logs into shorter longitudinal sections, comprising:

supporting the log on a row of tipple units each of which has two oppositely moveable swingable wings independently swingable transversely between a raised upwardly sloping position and a lowered log releasing position;

determining the cutting locations for dividing the log longitudinally into log sections of selected lengths;

moving cut-off saws along an established linear travel path to said cutting locations and lowering all of said wings located at said cutting locations out of a lateral cutting path of said saws;

operating said saws to cut transversely through the log at said cutting locations to obtain said log sections, there being sufficient of said wings remaining in raised position to support said log sections; and then lowering sufficient of said raised wings to release each of said log sections for discharge in a selected lateral direction.

14. A system for cutting logs into shorter longitudinal sections comprising:

supporting the log on a row of tipple units each of which has two oppositely moveable tipple wings independently swingable transversely between a raised upwardly sloping position and a lowered position;

determining the cutting locations for dividing the log longitudinally into log sections of selected lengths;

moving carriages each containing a laterally swingable cut-off saw and two hold-down arms along an established travel path to said cutting locations and lowering all of said wings located at said cutting locations out of the cutting range of said saw while continuing to support the log on the remaining of said tipple units;

pressing said log against said remaining tipples by said hold-down arms;

operating said saws to cut transversely through the log at said cutting locations to obtain said log sections; and releasing said hold-down wings and lowering sufficient of said wings to discharge said log sections.

15. Apparatus for cutting logs into shorter longitudinal sections, comprising:

a row of tipple units each of which has two oppositely swingable tipple wings independently swingable transversely between an outwardly sloped raised position and an outwardly sloped lowered position;

the tipple wings of each tipple unit being log supporting when both are in said raised position;

a row of carriages each containing a cut-off saw;

means for moving said carriages along an established travel path to variable cutting locations and for lowering all of said tipple wings located at said cutting locations to said lowered position, said tipple wings being out of the cutting range of said saw when in said lowered position;

said saws being operable to cut transversely through a log at said cutting locations supported by raised tipple wings to obtain said log sections; and said tipple units each having a mechanism for selectively raising and lowering said tipple wings between said raised and lowered positions.

16. Apparatus for cutting logs into shorter longitudinal sections, comprising:

a row of tipple units each moveable independently between a log supporting position and a log releasing position;

a control for setting cutting locations to divide the log longitudinally into log sections of selected lengths;

a row of saw carriages each having a cut-off blade and a log hold-down device;

means for moving said saw carriages along an established travel path to said cutting locations and for moving those of said tipple units which are located at said cutting locations out of the cutting range of said blades;

means for moving said hold-down devices into log hold-down position and moving said blades to cut through the log at said cutting locations to obtain said log sections, there being sufficient of said tipple units to provide support for said log sections while the log is being cut; and means for retracting said hold-down devices and blades.

17. Apparatus according to claim 16 in which each saw carriage has two of said log hold-down devices, one on each side of the respective said blade.

* * * * *